US010087797B2

(12) United States Patent
Mistry et al.

(10) Patent No.: US 10,087,797 B2
(45) Date of Patent: Oct. 2, 2018

(54) COMPRESSOR AND OIL DRAIN SYSTEM

(71) Applicant: Ingersoll-Rand Company, Davidson, NC (US)

(72) Inventors: Ritesh Kumar Mistry, Gujarat (IN); Dileep G. Patil, Ahmedabad (IN); Leandre Adifon, Mooresville, NC (US)

(73) Assignee: Ingersoll-Rand Company, Davidson, NC (US)

( * ) Notice: Subject to any disclaimer, the term of this patent is extended or adjusted under 35 U.S.C. 154(b) by 269 days.

(21) Appl. No.: 14/832,558

(22) Filed: Aug. 21, 2015

(65) Prior Publication Data

US 2017/0051645 A1 Feb. 23, 2017

(51) Int. Cl.

| | |
|---|---|
| ***F01M 11/04*** | (2006.01) |
| ***F01M 11/02*** | (2006.01) |
| ***F04B 39/02*** | (2006.01) |
| ***F02B 63/06*** | (2006.01) |
| ***F04B 41/06*** | (2006.01) |

(52) U.S. Cl.

CPC ..... *F01M 11/0458* (2013.01); *F01M 11/02* (2013.01); *F02B 63/06* (2013.01); *F04B 39/02* (2013.01); *F04B 39/0284* (2013.01); *F04B 41/06* (2013.01); *F01M 2011/0483* (2013.01)

(58) Field of Classification Search

CPC ..... F01M 11/0458; F01M 11/02; F02B 63/06; F04B 39/02; F04B 39/0284; F04B 41/06

See application file for complete search history.

(56) References Cited

U.S. PATENT DOCUMENTS

| | | | | |
|---|---|---|---|---|
| 2,490,687 | A | 12/1949 | Guarnaschelli | |
| 3,399,776 | A * | 9/1968 | Knuth | B01D 29/114 210/234 |
| 3,644,054 | A | 2/1972 | Pilarczyk | |
| 4,066,281 | A | 1/1978 | De Bonis | |
| 4,129,503 | A | 12/1978 | Joseph | |
| 4,559,782 | A | 12/1985 | Richey et al. | |
| 4,732,360 | A | 3/1988 | Bodenheimer | |
| 5,130,014 | A | 7/1992 | Volz | |
| 5,181,541 | A | 1/1993 | Bodenheimer | |
| 5,402,643 | A | 4/1995 | Buchanan et al. | |
| 5,454,354 | A * | 10/1995 | Miller | B01D 24/12 123/196 A |
| 5,626,468 | A | 5/1997 | Mulr et al. | |
| 5,640,936 | A | 6/1997 | Hudson | |
| 5,938,065 | A | 8/1999 | De Vivo et al. | |
| 6,010,320 | A | 1/2000 | Kwon | |
| 6,247,440 | B1 | 6/2001 | Gron, Jr. | |
| 6,769,248 | B2 | 8/2004 | Glberson et al. | |
| 7,374,208 | B2 * | 5/2008 | Yamamoto | B60K 15/063 180/327 |
| 8,740,251 | B2 | 6/2014 | Batson et al. | |
| 9,458,967 | B2 * | 10/2016 | Leising | F01M 5/002 |

(Continued)

*Primary Examiner* — Michael A Riegelman

(74) *Attorney, Agent, or Firm* — Taft Stettinius & Hollister LLP

(57) ABSTRACT

A compressor system is disclosed with a base structure configured to support a compressor. A removable oil reservoir is connectable with the base structure. An oil drain tube is configured to be in fluid communication with portions of the compressor system and the oil reservoir. The oil reservoir is configured to slidingly move relative to the base structure and engage with the oil drain tube in a fluid sealing arrangement.

14 Claims, 4 Drawing Sheets

(56) References Cited

U.S. PATENT DOCUMENTS

| | | | | |
|---|---|---|---|---|
| 9,677,551 | B2 * | 6/2017 | Mistry | F04B 23/02 |
| 2013/0078118 | A1 | 3/2013 | Maier et al. | |
| 2015/0291317 | A1 * | 10/2015 | Brett | F01M 11/04<br>220/661 |
| 2015/0292371 | A1 * | 10/2015 | Barnes | F01M 11/04<br>123/196 A |
| 2015/0292674 | A1 * | 10/2015 | Brett | F01M 11/04<br>220/562 |
| 2017/0051733 | A1 * | 2/2017 | Mistry | F04B 23/02 |
| 2017/0159872 | A1 * | 6/2017 | Mistry | F01D 25/28 |

* cited by examiner

COMPRESSOR AND OIL DRAIN SYSTEM

TECHNICAL FIELD

The present application generally relates to industrial air compressor systems and more particularly, but not exclusively, to a compressor system with a removable reservoir and slidable drain tube coupling.

BACKGROUND

Large industrial compressor systems typically have complex design, assembly and maintenance procedures. These industrial systems can be difficult to maintain and/or repair due to their large size and weight. An improved oil drain and supply system can reduce costs related to serviceability as well as to help increase the durability of the system. Some existing systems have various shortcomings relative to certain applications. Accordingly, there remains a need for further contributions in this area of technology.

SUMMARY

One embodiment of the present invention is a unique compressor system. Other embodiments include apparatuses, systems, devices, hardware, methods, and combinations for compressor systems with a unique oil drain and supply system. Further embodiments, forms, features, aspects, benefits, and advantages of the present application shall become apparent from the description and figures provided herewith.

DETAILED DESCRIPTION OF THE ILLUSTRATIVE EMBODIMENTS

Figure 1:
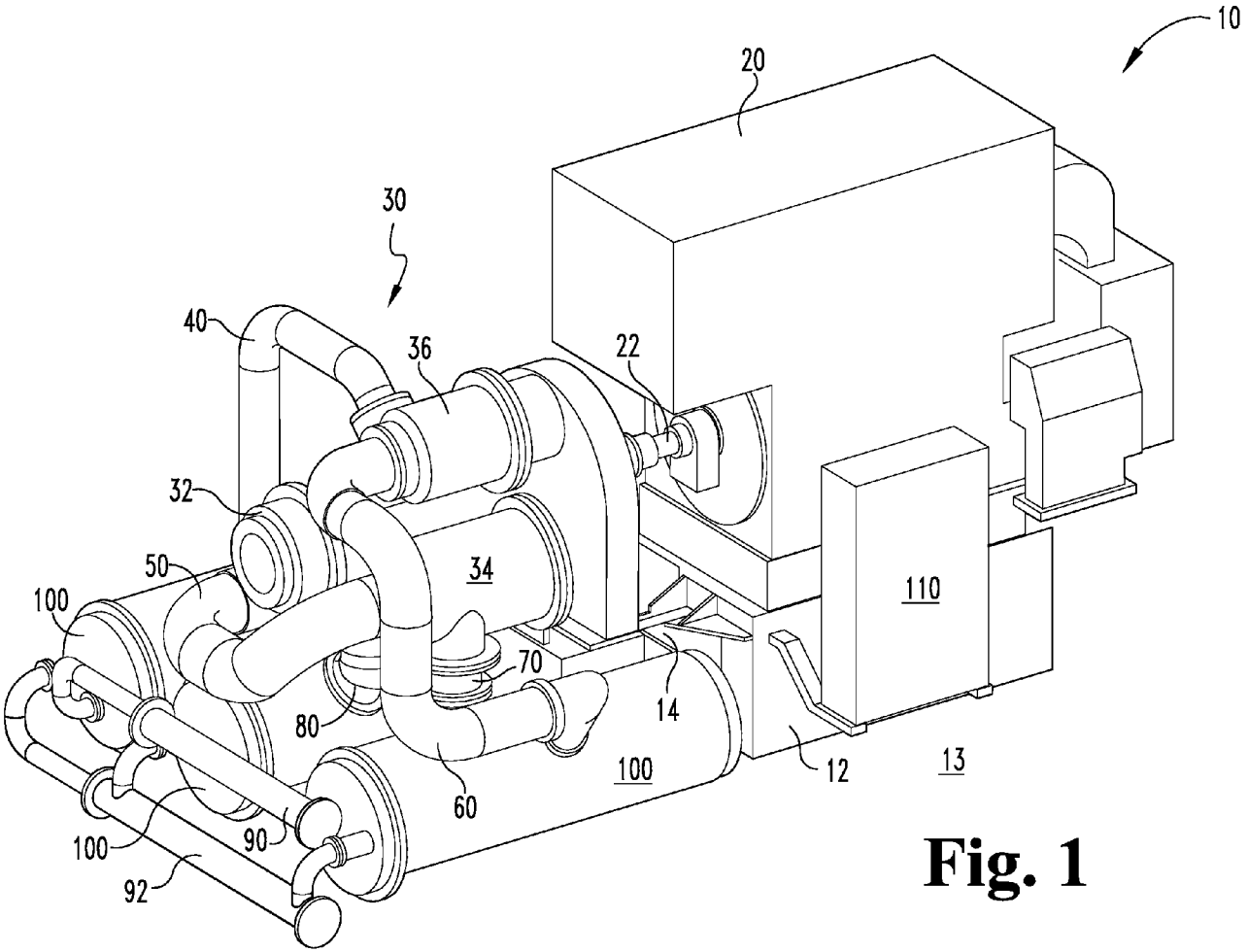
FIG. 1 is a perspective view of a compressor system according to one embodiment of the present disclosure.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Industrial compressor systems can have many large and complex features such as external fluid to fluid heat exchangers or intercoolers, a motive source to drive the compressors and a lubrication system to supply lubrication fluid to system components as required. Large compressor systems typically have a main base or support structure to support the compressor system components during operation. Some base support structures have lubrication systems with built in oil reservoirs specifically designed for individual or distinct compressor systems. The lubrication system typically includes a reservoir for holding lubricating fluid such as oil, one or more fluid conduits connected to the reservoir and pumps for drawing oil from the reservoir and delivering the oil to defined locations in the system. The present disclosure provides for a removable oil reservoir for a system constructed to operate with a wide variety of compressor system types or sizes so as to provide flexibility in the system design and reduce weight of the support base structure.

Referring now to FIG. 1, an exemplary compressor system 10 is shown therein. The compressor system 10 includes a primary motive source 20 such as an electric motor, an internal combustion engine or a fluid-driven turbine and the like. The compressor system 10 can include a compressor 30 with multi-stage compression and in the exemplary embodiment includes a first stage compressor 32, a second stage compressor 34, and a third stage compressor 36. In other embodiments a different number of compressor stages may be employed with the compressor 30. The compressor 30 can include centrifugal, axial and/or positive displacement compression means. The primary motive source 20 is operable for driving the compressor 30 via a drive shaft 22 to compress fluids such as air or the like. The term "fluid" should be understood to include any gas or liquid medium that can be used in a compressor system as disclosed herein.

A structural base 12 is configured to support at least portions of the compressor system 10 on a support surface 13 such as a floor or ground and the like. One or more extensions or arms 14 can extend from the base 12 and is configured to hold portions of the compressor system 10 suspended above the support surface 13. Portions of the compressed air discharged from the compressor 30 can be transported through more one or more conduits 40, 50, 60, 70 and 80 to one or more intercoolers 100 and/or to another compressor stage. An inlet fluid manifold 90 and an outlet fluid manifold 92 can be fluidly connected to the intercoolers 100 to provide cooling fluid such as water or other liquid coolant to cool the compressed air after discharge from one or more of the compressor stages of the compressor 30. The compressor system 10 can also include a controller 110 operable for controlling the primary motive power source and various valving and fluid control mechanisms (not shown) between the compressor 30 and intercoolers 100.

Figure 2:
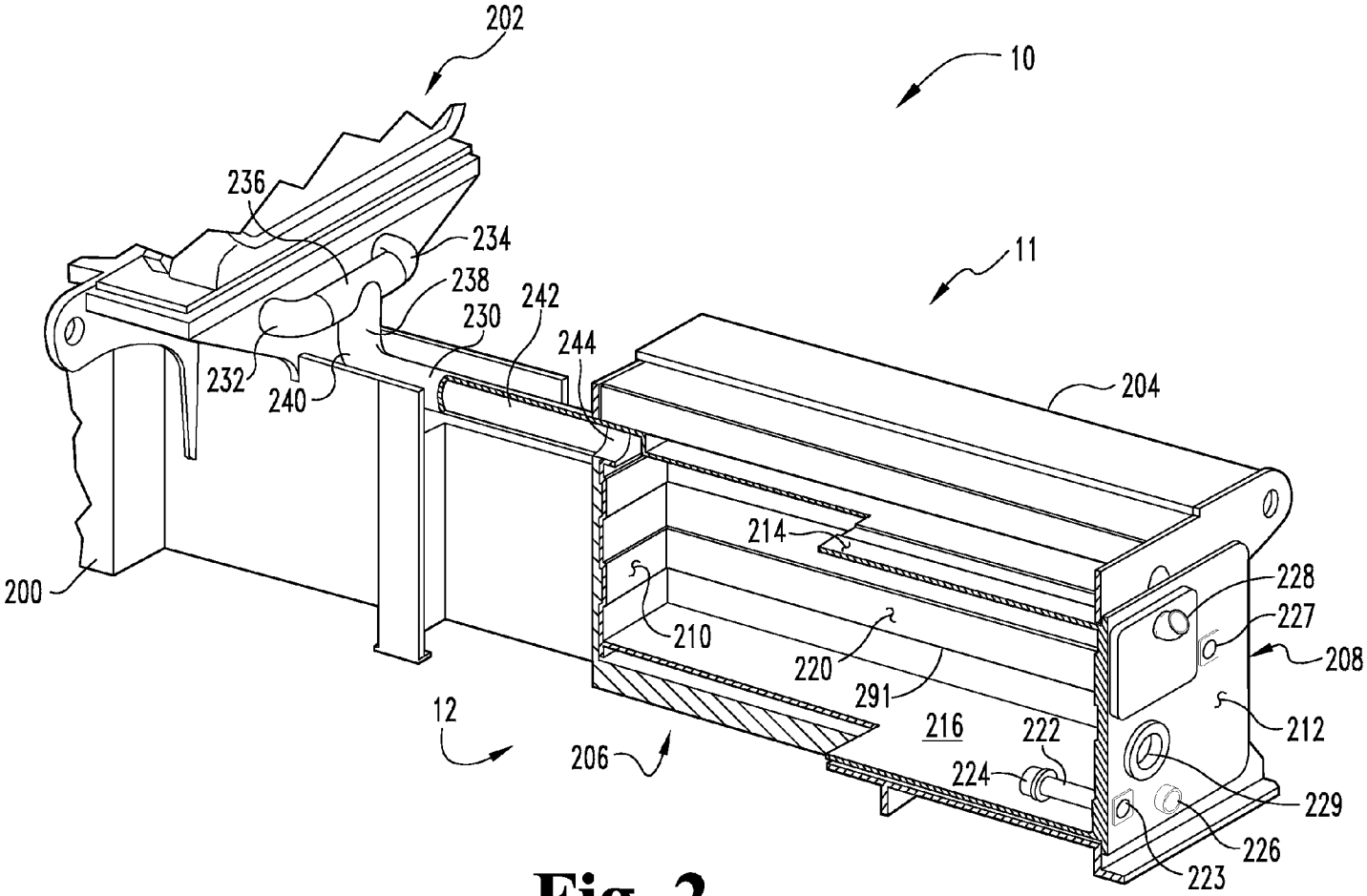
FIG. 2 is a perspective view of a portion of an oil drain and supply system for the compressor system of FIG. 1.

Referring now to FIG. 2, a portion of the compressor system 10 is shown with many of the components removed for clarity to illustrate an oil drain system 11 partially cut away. The structural base 12 can include a first portion 200 that can support an air-end compression system 202 that is also shown mostly cutaway for clarity. A second portion 204 of the base 12 can be constructed to support the drive motor 20 (not shown) and other components of the compressor system 10. The second portion 204 can include a reservoir cavity 206 configured to receive a removable oil reservoir 208 therein. It should be understood the term oil can include any type of lubricant such as a petroleum based or synthetic formulation may be used in the compressor system 10.

Figure 3:
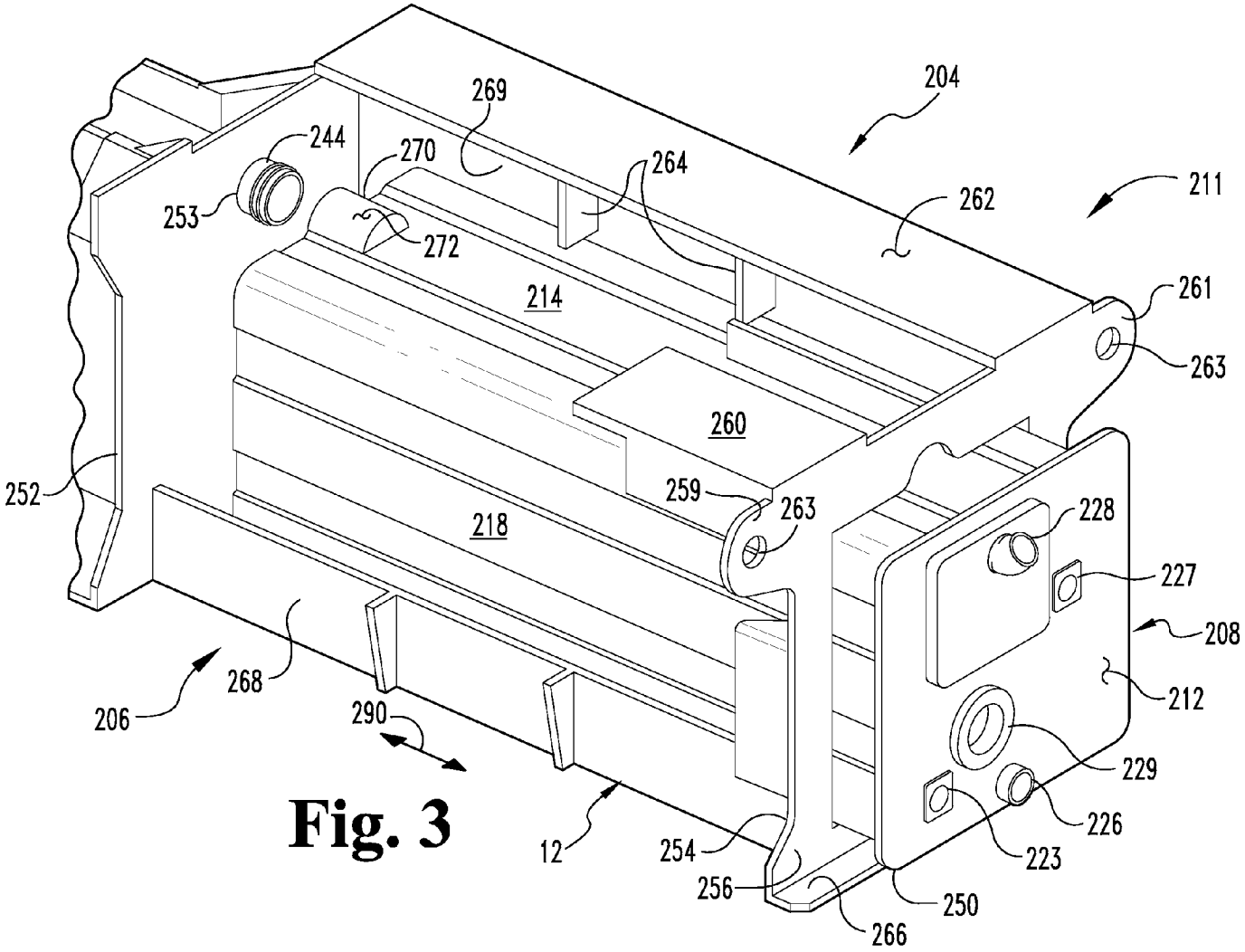
FIG. 3 is an enlarged perspective view of a removable oil reservoir displaced from a drain tube coupling.

The removable oil reservoir 208 can include a first endwall 210 positioned toward the air-end compression system 202 and a second endwall 212 positioned on the opposing end of the removable reservoir 208. The removable oil reservoir 208 can include a topwall 214 that is shown partially cut away and a bottom wall 216 also shown partially cut away extending between the first and second endwalls 210, 212 respectively. A first sidewall 218 is completely removed in FIG. 2, but is shown in FIG. 3 and a second opposing sidewall 220 can extend laterally between the top and bottom walls 214, 216 and longitudinally between the first and second endwalls 210, 212 of the reservoir 208.

In this exemplary embodiment the removable oil reservoir 208 is formed substantially as a rectangular cylinder however, other forms can be employed as desired. For example, the removable oil reservoir could be round or ovalized or have a fewer number or a larger number of sidewalls than that illustrated in the drawing. In one form the removable reservoir can be formed from sheet metal having a minimal thickness to reduce weight while maintaining structural integrity. The sheet metal can be formed into walls that include corrugations or ribs 291 to increase stiffness of the reservoir 208. Various portions of the sheet metal construction can include fluid tight mechanical joining of the reservoir walls. Such, non-limiting examples of mechanical joining techniques can include weld, braze, adhesive, threaded and non-threaded fasteners or other types known to those skilled in the art. In other embodiments, the removable reservoir can be formed from a unitary single piece construction through casting, hydroforming, forging, and machining. Suitable materials for construction can include but are not limited to aluminum, steel, cast iron, metal alloys, composites, and plastics.

The removable reservoir 208 can include a plurality of features formed in one or more of the walls 210, 212, 214, 216, 218 and 220 such as a transfer tube 222 connected to a port 223 extending through the endwall 212. The transfer tube 222 can include a suction strainer 224 operable for filtering lubricating fluid upstream of a pump (not shown). Other features can include one or more through apertures 226 and 227 for access ports and the like. A third port 229 that is substantially larger than the access ports 226 and 227 can also be formed through the endwall 212. An oil fill port 228 can be similarly connected to the removable oil reservoir 208 as shown in the drawing. Each of these access ports and transfer tubes are shown are exemplary in nature and should not be construed as being necessary or required to practice the teachings of the present application.

An oil drain conduit or tube 230 can extend from the air-end compression system 202 toward the removable reservoir 208. The oil drain conduit 230 can include a first connection port 232 and a second connection port 234 connected to one or more oil flow paths in fluid communication with the compressors 32, 34, 36 and/or other portions of the system 10 shown in FIG. 1. The connection ports 232, 234 can extend to a common manifold 236 and downward toward a manifold outlet 238. An elbow 240 can fluidly connect the manifold outlet 238 to an elongate portion 242 of the drain conduit 230. A tube coupling end 244 is formed at a distal end of the drain conduit 230 to couple with the reservoir 28 and will be described in more detail below.

While the exemplary embodiment illustrates a dual port connection 232, 234 with an elbow 240 extending therefrom, it should be understood that other conduit configurations can be used and are contemplated by the present disclosure. The oil drain conduit 230 can be formed of a pipe or tube having a wall thickness sufficient to remain substantially stiff or rigid in the axial or longitudinal direction during assembly or connection with the removable oil reservoir and during system operation. The oil drain conduit 230 can provide some flexibility in a lateral or radial direction to provide tolerance for sliding connectivity with the removable oil reservoir 208 in some embodiments. In addition the sealing arrangement between the oil drain conduit 230 and the removable reservoir 208 also can provide some flexibility for lateral or radial positioning of the interface between the conduit and reservoir 230, 208 respectively.

Referring now to FIG. 3, an enlarged view of the second portion 204 of the oil drain system 211 is shown therein. The second end wall 212 of the removable oil reservoir 208 can include an outer perimeter rim 250 that protrudes outward from the sidewalls 218, 220 and the top and bottom walls 214, 216 of the oil reservoir 208. The reservoir cavity 206 can include a first endwall 252 positioned toward the air-end 202 of the compressor system 10 and a second endwall 254 positioned on the opposing end of the oil reservoir cavity 206. The second endwall 254 can include a flange face 256 extending radially outward to provide an engagement surface for the perimeter rim 250 of the removable oil reservoir 208 to engage therewith. In other embodiments, the second endwall 212 may not protrude outward past the walls 214, 216, 218, and/or 220 and may not engage with the second endwall 254 of the reservoir cavity 206.

The second portion 204 of the base 12 can include a first upper support surface 260 and a second upper support surface 262 spaced apart from the first upper surface 260 and extending along the top of the oil reservoir cavity 206. The support surfaces 260, 262 are constructed to support portions of the compressor system 10. In other exemplary forms the first and second upper support surfaces 260, 262 can be substantially a single upper support surface with no separating portions formed therebetween. One or more reinforcing ribs 264 can extend from one or both of the upper support surfaces 260, 262 to provide additional strength to the base 12. The oil reservoir cavity 206 can also include a bottom support wall 266 and a sidewall support 268 extending from the bottom support wall 266 between the first and second endwalls 252, 254 thereof. The sidewall support 268 can extend partially toward the upper support surfaces 260, 262 in some embodiments and can extend to the upper support surfaces 260, 262 in other embodiments of the oil reservoir cavity 206. The oil reservoir cavity 206 can also include a second sidewall 269 opposite of sidewall support 268 extending partially or completely between the first and second endwalls 252, 254 respectively.

The flange face 256 of the second end wall 254 can include first and second attachment ears 259, 261 extending outwardly therefrom. One or more apertures such as apertures 263 can be formed through the ears 259, 261 to provide an attachment feature for lifting the compressor system 10 or the like. In some forms the ears 259, 261 can be used to attach the base 12 to portions of the compressor system 10.

An oil drain tube coupling boss 270 can extend from the first end wall 210 (see FIG. 2) to provide a connection port for the oil drain conduit 230. In one form, the coupling boss 270 can include an arcuate protruding surface 272 extending above the top wall 214 of the removable oil reservoir 208. In other forms, the oil tube coupling boss 270 can be formed such that the outer perimeter thereof is positioned within the outer perimeter of the walls of the removable oil reservoir 208. The coupling boss 270 can be integrally formed with the oil reservoir 208, however in alternate embodiments the coupling boss 270 can be separately formed and mechanically attached via a weld, braze, adhesive or other mechanical joining means known to those skilled in the art.

The tube coupling end 244 of the oil drain conduit 230 can extend through the first endwall 252 via a through aperture 253 formed in the first endwall 252 of the reservoir cavity 206. In some forms the tube coupling end 244 can be pressfit into through aperture 253 or have other mechanical locking means to hold the tube coupling end 244 with respect to first end wall 252. However, in other embodiments, the tube coupling end 244 can freely move within the aperture 253 and with respect to the reservoir cavity 206. The removable oil reservoir 208 can slide into and out of the reservoir cavity 206 in a longitudinal direction defined by double arrowed line 290 to connect or disconnect from the tube coupling end 244. In one form, the removable reservoir 208 can be releasably fixed within the reservoir cavity 206 via one or more threaded fasteners (not shown) connecting a portion of the reservoir 208 to a portion of the base 12 or with an interference or an abutment mechanism. In other forms, the removable reservoir 208 is substantially free of mechanical connection to the base 12. In some configurations the tube coupling end 244 of the drain conduit 230 is free to move with respect to the coupling boss 270 in an axial direction without interference or abutment.

Figure 4:
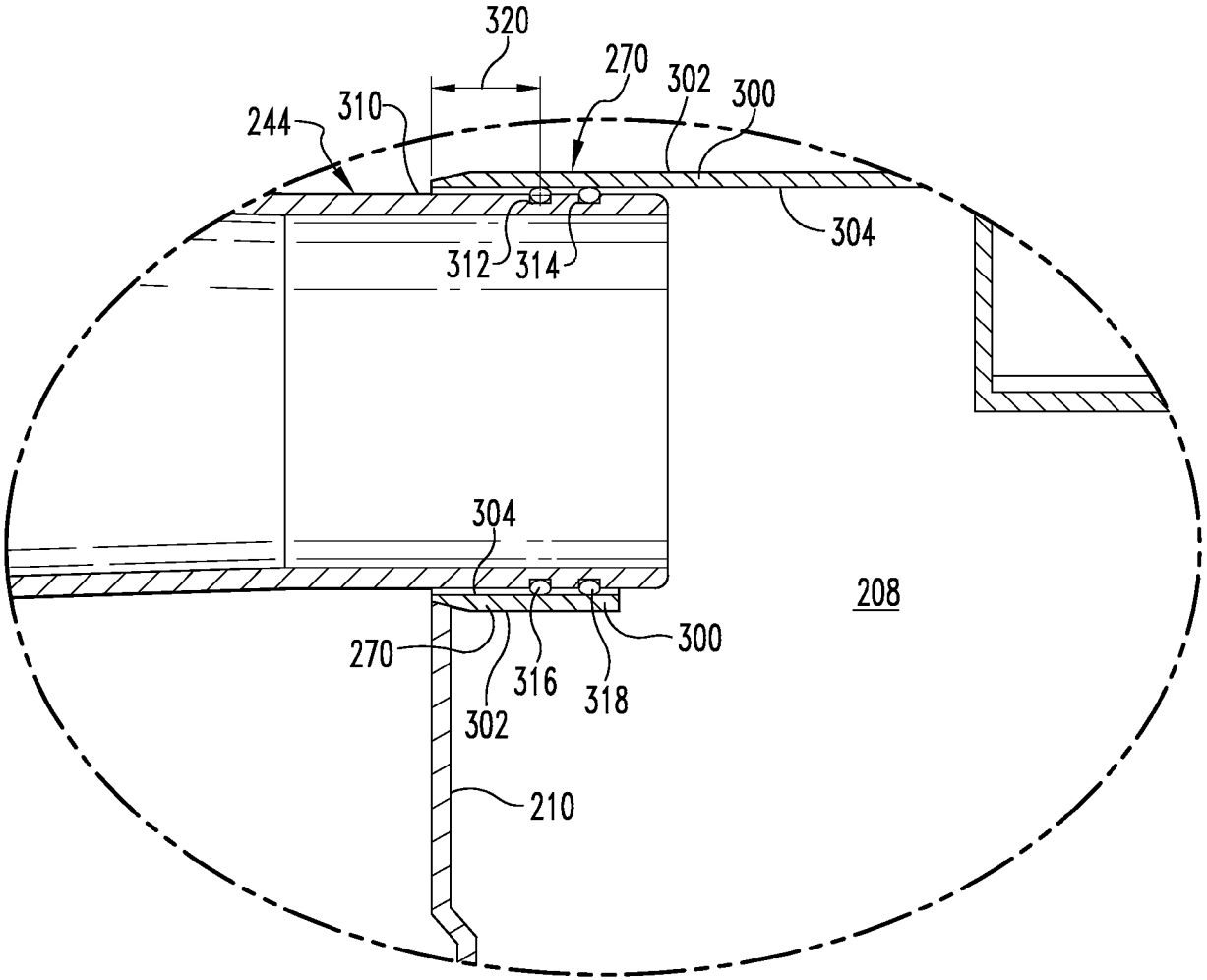
FIG. 4 is a cross sectional view of a portion of the oil drain tube coupling and the removable oil reservoir.

Referring now to FIG. 4, an enlarged cross-sectional view of the drain tube coupling end 244 in an engaged position with the coupling boss 270 is shown therein. The coupling boss 270 can include a circumferential wall 300 extending around the drain tube coupling end 244. The circumferential wall 300 can include an outer circular surface 302 and an inner circular surface 304 operably engageable with the drain tube coupling end 244. One or more seals may be employed to provide a fluid tight seal between the coupling boss 270 and the drain tube coupling end 244. In the exemplary embodiment, the drain tube coupling end 244 can include an outer surface 310 with a first O-ring groove 312 and a second O-ring groove 314 formed therein. The first and second O-ring grooves 312, 314 can be spaced axially apart from one another and extend circumferentially about the outer surface 310 of the drain tube coupling end 244. A first O-ring seal 316 can be positioned within the first O-ring groove 312 and second O-ring seal 318 can be positioned within the second O-ring groove 314 such that a fluid tight seal can be formed between the outer surface 310 of the oil drain tube coupling end 244 and the inner surface 304 of the circumferential wall 300 of the coupling boss 270. In other embodiments one or more O-ring grooves may be formed in the inner surface 304 of the coupling boss 270 in lieu of O-ring grooves being formed in the drain tube coupling end 244. In yet other forms different seal arrangements may be employed such as by way of a single O-ring seal or other types of seal mechanisms including lip seals or the like.

The drain tube conduit 230 and the coupling boss 270 can be made from one or more of a plurality of materials such as metals, composites, intermetallics and the like and are configured to be substantially inflexible or rigid in some directions or orientations and can be flexible or non-rigid in other directions or orientations. The fluid seals can be made from any fluid impervious material desired, but typically include materials having a high temperature and high pressure capability such as a Fluoroelastomers, nitrile rubber, silicone rubber and the like. The temperature capability requirements are defined by operating temperatures of the system 10 and can range for ambient temperature to several hundred degrees Fahrenheit.

The removable oil reservoir 208 can slide axially or longitudinally within the oil reservoir cavity 206 defined by the direction of double arrow 290 (see FIG. 3) to a predefined position in the support base 12 to hold a supply of oil for the compressor system 10. The drain tube coupling end 244 can extend through the first end wall 252 of the reservoir cavity 206 and couple with the coupling boss 270 of the removable oil reservoir 208 in a sealing manner.

The removable oil reservoir 208 can be completely removed from the support base 12 by sliding the oil reservoir 208 outward from the reservoir cavity 206. Removal of the oil reservoir 208 can provide access for system maintenance or the like. When the removable oil reservoir 208 is slidingly moved toward the first endwall 252 of the oil reservoir cavity 206 the coupling boss 270 will slidingly engage with the tube coupling end 244 of the oil drain tube 230. The seals 316 and 318 of the oil drain tube 230 form a fluid tight seal between the tube coupling end 244 and the coupling boss 270 of the removable reservoir 208. In this manner a fluid is prevented from moving past the interface of the oil reservoir 208 and the oil drain tube 230.

Relative movement between the reservoir 208 and the oil drain tube 230 can be accommodated along the direction defined by double arrow 320. Because there is not an abutment or other restriction between the oil reservoir 208 and the oil drain tube 230, the inner surface 304 of the coupling boss 270 can move freely relative to the coupling end 244 due to the thermal expansion or other mechanical forces applied during system operation as well as during installation. In this manner, a fluid tight seal between the oil drain tube 230 and the removable reservoir 208 can remain operable while providing variable or flexible positioning between the engaged portions of the oil drain tube 230 and the removable reservoir 208.

In operation the compressor system is configured to provide compressed air at a desired temperature and pressure to external systems. The compressor system can be used in any industrial application including but not limited to automobile manufacturing, textile manufacturing, process industries, refineries, power plants, mining, material handling, etc. The controller permits user input to define parameters such as pressure, temperature and mass flow rate. The controller will send command signals to the motor to rotate at a desired operating speed in order to drive the one or more compressors and control various valving to control airflow rate, coolant flow rate and/or lubrication flow rates.

In the illustrative example, the compressor system includes a three-stage centrifugal compressor system, however, the system can operate with other types of compressors and/or with more or less stages of compressors. In some embodiments one or more intercoolers can be fluidly coupled to each compressor stage such that after air is compressed through the first stage the air can be transported through a first intercooler and can be cooled to a desired temperature via a heat transfer mechanism such as conduction and convection in tube type heat exchangers.

The compressed air can then be transported into a second stage compressor where the air further compressed and necessarily heated to a higher temperature through a thermodynamic process. The second stage compressed air can then be routed through a second intercooler to cool the air to desired temperature while remaining at or close to the compressor outlet pressure of the second stage compressor. The cooled compressed air exiting from the second intercooler can then be transported to a third stage compressor where it is compressed to a final desired pressure and then subsequently routed to a third stage intercooler to bring the temperature of the final discharged air pressure to the desired temperature for delivery to a final subsystem.

In one form the compressors can be centrifugal compressors, however, other forms of compression can include axial flow compressors, piston compressors or other positive displacement compressors can be used under the teachings of the present disclosure. The lubrication system supplies lubricant such as oil to the compressor and/or other system components such as the motor. The lubricant is circulated throughout the system and then removed or drained through an oil drain conduit fluidly coupled to the lubrication system. The oil drain conduit is fluidly connected in a slidingly engageable fashion with a removable oil reservoir. Oil can be returned to the reservoir through the oil drain conduit and supplied back to the compressor system by an oil pump or the like as is conventional.

In one aspect, the present disclosure includes a compressor system comprising: a base structure configured to support a compressor; an oil reservoir connectable with the base structure; an oil drain tube in fluid communication with the compressor and the oil reservoir; a drain connection formed with the oil reservoir; wherein each of the drain connection and the oil drain tube is free from axial abutment such that axial movement of the oil drain tube is unrestricted with respect to the drain connection.

In refining aspects, the compressor system includes at least portions of the drain connection and the oil drain tube are movable relative to one other during operation of the compressor system; the oil drain tube is configured to slide into and out of engagement with the oil reservoir; the oil drain tube is fixed to a portion of the compressor system; the oil drain tube includes more than one fluid connection with portions of the compressor system; the drain connection includes a coupling boss extending therefrom for slidingly receiving a coupling end of the oil drain tube; the drain connection and the oil drain tube engage in a sealing arrangement; the sealing arrangement includes at least one fluid seal coupled between the oil drain tube and the reservoir; and the oil drain tube is substantially rigid in at least one direction.

In another aspect, the present disclosure includes an apparatus comprising: a support base for supporting portions of a compressor system; at least one hollow reservoir cavity formed in the support base; a fluid reservoir disposed within the hollow reservoir cavity; at least one conduit fluidly connected between a compressor and the fluid reservoir; and a connection between the conduit and the fluid reservoir being free from abutment in an axial direction to permit relative movement of the conduit and the fluid reservoir during installation and operation.

In refining aspects, the conduit is configured to receive lubricating fluid from at least one compressor and transfer the fluid to the reservoir; the reservoir includes a conduit coupling boss with an accurate surface extending from a top wall of the reservoir; further comprising: a fluid tight seal formed between the conduit and the reservoir; the fluid tight seal permits sliding movement between the conduit and a reservoir coupling; and the fluid tight seal includes at least one O-ring operably coupled to one of the conduit and the reservoir.

In another aspect the present disclosure includes a method comprising: positioning a compressor system and an oil reservoir on a base structure; attaching a compressor drain conduit to a portion of the compressor system; fluidly sealing an interface between the compressor drain conduit and an oil reservoir coupling; and slidingly engaging the drain conduit with the oil reservoir coupling, wherein the slidingly engaging is free from restriction between the drain conduit and the oil reservoir coupling in an axial direction.

In refining aspects, the includes: moving the drain conduit and reservoir relative to one another during system operation while retaining a fluid tight seal therebetween; wherein the moving includes movement caused by thermal expansion of portions of the compressor system; wherein the sealing includes positioning an O-ring seal between the drain conduit and the reservoir coupling; and wherein the drain conduit is substantially rigid in the axial direction.

In another aspect, the present disclosure includes a compressor system comprising: a base structure configured to support a compressor; a removable oil reservoir connectable with the base structure; an oil drain tube in fluid communication with the compressor and the oil reservoir; and wherein the oil reservoir is configured to slidingly move relative to the base structure and engage with the oil drain tube in a fluid sealing arrangement.

In refining aspects, at least a portion of the oil reservoir is moveable relative to the oil drain tube during compressor system operation; the oil reservoir is configured to slide out of engagement with the oil drain tube and the base structure during removal; the removable oil reservoir is formed from sheet metal construction; the sheet metal construction includes fluid tight joining means; the removable reservoir includes a coupling boss extending therefrom for slidingly receiving a coupling end of the oil drain tube; the sealing arrangement includes at least one fluid seal positioned between the oil drain tube and the oil reservoir; at least one fluid seal is an O-ring seal coupled to one of the oil drain tube and the reservoir; and the oil drain tube is substantially rigid in a longitudinal direction.

In another aspect, the present disclosure includes an apparatus comprising: a support base for supporting portions of a compressor system; at least one hollow reservoir cavity formed in the support base; at least one removable fluid reservoir configured to slidingly engage within the hollow reservoir cavity; and at least one longitudinally rigid conduit fluidly connected to the compressor system and being slidingly engageable with the removable reservoir.

In refining aspects, the removable reservoir is formed at least partially from a sheet metal construction; a portion of the sheet metal construction includes at least one of a corrugation and ribs the reservoir includes a conduit coupling boss with an accurate surface extending from a wall of the reservoir; a fluid tight seal is formed between the conduit and the reservoir; the fluid tight seal is configured to permit sliding movement between the conduit and a coupling connected with the reservoir; and an interface between the conduit and the coupling is devoid of restrictive abutment such that the sliding movement is unrestricted.

In another aspect, the present disclosure includes a method comprising: positioning a compressor system on a base structure; attaching a compressor drain conduit to a portion of the compressor system; sliding a removable reservoir into a receiving cavity formed within the base structure; slidingly engaging a reservoir coupling with the drain conduit; and fluidly sealing an interface connection between the compressor drain conduit and reservoir coupling.

In refining aspects, the method includes moving the drain conduit and reservoir relative to one another without restriction at the interface connection therebetween; and retaining a fluid tight seal during the moving; removing the oil reservoir by sliding the reservoir out of the receiving cavity and out of engagement with the drain conduit; positioning an O-ring between the drain conduit and the reservoir coupling; the removable oil reservoir is formed from a sheet metal construction; and the sheet metal construction includes corrugations and/or stiffening ribs.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

What is claimed is:

1. A compressor system comprising:

a base structure configured to support a compressor;

a removable oil reservoir connectable within a fixed walled housing of the base structure;

an oil drain tube in fluid communication with the compressor and the oil reservoir;

wherein the oil reservoir is configured to slidingly move within the fixed walled housing of the base structure and engage with the oil drain tube in a fluid sealing arrangement; and wherein the oil drain tube and a coupling on the oil reservoir are slidably moveable without restriction relative to one another when engaged during compressor system operation.

2. The compressor system of claim 1, wherein the oil reservoir is configured to slide out of engagement with the oil drain tube and the base structure during removal.

3. The compressor system of claim 1, wherein the removable oil reservoir is formed from sheet metal construction.

4. The compressor system of claim 3, wherein the sheet metal construction includes fluid tight joining means.

5. The compressor system of claim 1, wherein the removable reservoir includes a coupling boss extending therefrom for slidingly receiving a coupling end of the oil drain tube.

6. The compressor system of claim 1, wherein the sealing arrangement includes at least one fluid seal positioned between the oil drain tube and the oil reservoir.

7. The compressor system of claim 6, wherein at least one fluid seal is an O-ring seal coupled to one of the oil drain tube and the reservoir.

8. The compressor system of claim 1, wherein the oil drain tube is substantially rigid in a longitudinal direction.

9. An apparatus comprising:

a support base configured to support and hold portions of a compressor system above a ground surface;

at least one hollow reservoir cavity having fixed walls formed in the support base;

at least one removable fluid reservoir configured to slidingly engage within the hollow reservoir cavity;

at least one longitudinally rigid conduit fluidly connected to the compressor system and being slidingly engageable within the removable reservoir during operation; and wherein an interface between the conduit and the removable reservoir is devoid of restrictive abutment such that the sliding movement is unrestricted.

10. The apparatus of claim 9, wherein the removable reservoir is formed at least partially from a sheet metal construction.

11. The apparatus of claim 10, wherein a portion of the sheet metal construction includes at least one of a corrugation and ribs.

12. The apparatus of claim 9, wherein the reservoir includes a conduit coupling boss with an accurate surface extending from a wall of the reservoir.

13. The apparatus of claim 9, further comprising:

a fluid tight seal formed between the conduit and the reservoir.

14. The apparatus of claim 13, wherein the fluid tight seal is configured to permit sliding movement between the conduit and a coupling connected with the reservoir.

* * * * *